United States Patent [19]

Marcus et al.

[11] Patent Number: 4,568,270

[45] Date of Patent: Feb. 4, 1986

[54] BICONSTITUENT CANDLE

[75] Inventors: Edward J. Marcus, New York, N.Y.; Fred Ortiz, Sante Fe, N. Mex.

[73] Assignee: Ortiz, Inc., Sante Fe, N. Mex.

[21] Appl. No.: 707,395

[22] Filed: Mar. 1, 1985

[51] Int. Cl.[4] ..... F23D 3/16

[52] U.S. Cl. ..... 431/288; 431/126; 44/7.5; 422/126

[58] Field of Search ..... 431/126, 288–297; 44/7.5; 422/125, 126

[56] References Cited

U.S. PATENT DOCUMENTS

| | | | |
|---|---|---|---|
| 2,974,509 | 3/1961 | Penke | 431/288 |
| 3,898,039 | 8/1975 | Lin | 431/288 X |
| 4,005,978 | 2/1977 | Calabretta et al. | 431/288 |
| 4,028,045 | 6/1977 | Reiher | 431/289 |

FOREIGN PATENT DOCUMENTS

| | | | |
|---|---|---|---|
| 29469 | 5/1958 | Finland | 431/288 |

*Primary Examiner*—Margaret A. Focarino
*Attorney, Agent, or Firm*—Lewis H. Eslinger

[57] ABSTRACT

A free-standing fragrance candle comprises an outer shell, an inner core and a wick. The shell is formed of paraffin, a wax, a mixture thereof, or any of these materials in combination with fragrance oil. The shell has a melting point high enough that the shell stands freely and is not tacky at room temperature. The core is formed of fragrance oil and a carrier therefor. The fragrance oil in the core constitutes from 5% to 12% of the total weight of the core. The carrier is petrolatum, a low melting point wax, paraffin, or a mixture thereof. The core has a melting point substantially lower than the melting point of the shell and low enough to form a molten pool within the shell and to ensure a substantial release of fragrance into the surrounding atmosphere as the candle burns. The shell constitutes a container and provides structural support for the core.

22 Claims, 7 Drawing Figures

FIG. 1
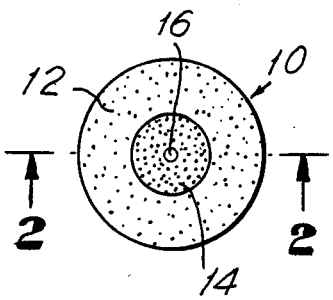
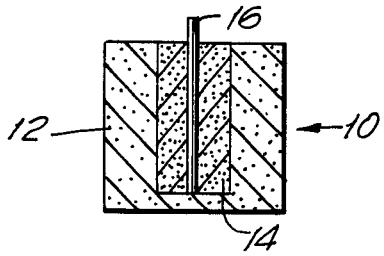
FIG. 2
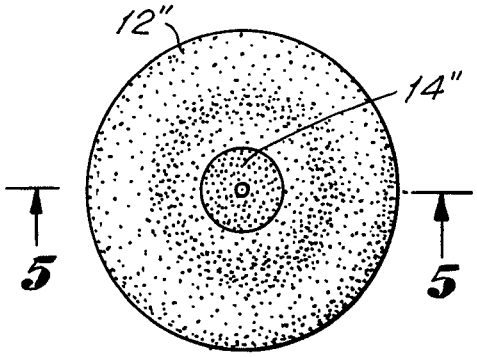
FIG. 4
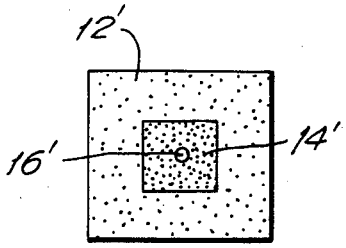
FIG. 3
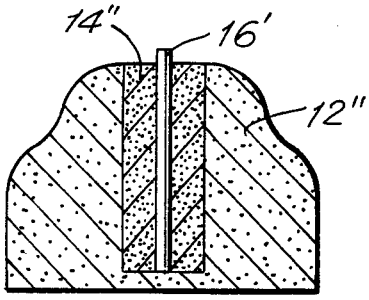
FIG. 5
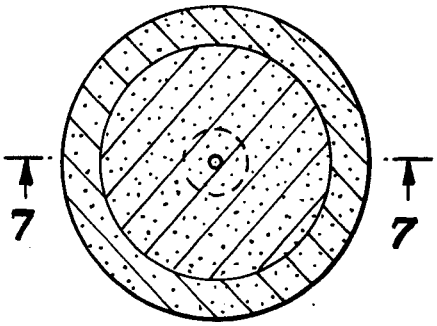
FIG. 6
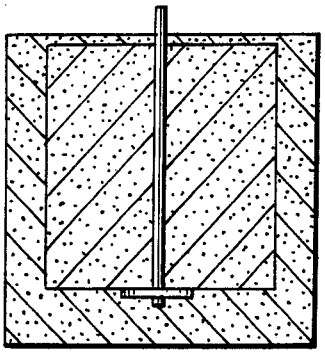
FIG. 7

BICONSTITUENT CANDLE

BACKGROUND OF THE INVENTION

1. Field of the Invention

This invention relates to candles and, more particularly, to a novel and highly-effective free-standing fragrance candle.

2. Description of the Prior Art

Candles have been known and used for centuries. In many cultures they were once a major source of night-time illumination. With the advent of kerosene and whale oil lamps and of gas light, and more recently of incandescent, fluorescent and other modern forms of illumination, candles have become less important sources of light for "serious" purposes but are still valued for the qualities of their light that are variously described as "soft" and "warm". Thus they are popular as sole or auxiliary sources of light during evening meals, certain holiday celebrations, etc.

Recently candles have been developed that appeal to the olfactory as well as the visual sense. Such candles incorporate fragrance oil and when burned release a scent containing various "notes" depending on the composition of the fragrance oil. There is virtually no limit to the number of fragrances that can be released in this way, and fragrance candles have become a popular adjunct to parties and similar festive occasions.

Conventional fragrance candles have serious drawbacks that both increase their cost and limit their appeal. The incorporation of fragrance oil into a candle in a quantity sufficient to ensure an abundant release of fragrance makes the candle tacky or oily and generally messy and disagreeable to the touch and deprives the candle of sufficient structural properties to enable it to resist damage and stand freely. Conventional fragrance candles are therefore protected and supported by rigid, nonflammable, sometimes decorative containers of various kinds, typically made of glass or another ceramic material.

This naturally adds substantially to the cost of material, shipping and storage. For example, shipping costs normally depend on weight, volume, or both (as well as on other factors). The addition of a glass container for each candle increases both weight and volume to a substantial degree and therefore makes the shipping of fragrance candles much more expensive than the shipping of ordinary unscented candles. In principle the glass container could be dispensed with by shipping the candles in a refrigerated shipping container, but refrigerated shipments entail additional expense and are by no means a total solution to the problem, because the candles must be capable of warehousing and ultimate use at room temperature.

At room temperature, particularly during the summer, fragrance candles become so soft that they lack sufficient structural properties to stand freely. If deprived of the support of a container they become misshapen and essentially unacceptable to consumers.

OBJECTS AND SUMMARY OF THE INVENTION

An object of the invention is to remedy the problems of conventional fragrance candles outlined above. In particular, an object of the invention is to provide a fragrance candle that releases an abundance of fragrance into the surrounding atmosphere as the candle burns, that has a pleasant, dry, waxy, non-oily feel, is not messy to handle and does not stain or soil proximal objects, and that has enough hardness and structural strength to resist damage and retain its shape, even in warm weather, while standing without a container.

Another object of the invention is to provide a fragrance candle that is less expensive to manufacture, ship and store than conventional fragrance candles.

Other objects of the invention are to provide a candle that is adapted to emit an abundance of any fragrance that can be emitted by a conventional fragrance candle and that can have any shape that a conventional unscented candle can have.

In accordance with one aspect of the invention, a free-standing fragrance candle comprises an outer shell, an inner core and a wick; the shell being formed of a material selected from the group consisting essentially of paraffin, a wax, a mixture thereof, and any of the preceding materials in combination with fragrance oil; the shell having a melting point high enough that the shell stands freely and is not tacky at room temperature; the core being formed of fragrance oil and a carrier therefor; the fragrance oil in the core constituting from 5% to 12% of the total weight of the core; the carrier being a material selected from the group consisting essentially of petrolatum, a low melting point wax, and a mixture thereof; the core having a melting point substantially lower than the melting point of the shell and low enough to form a molten pool within the shell and to ensure a substantial release of fragrance into the surrounding atmosphere as the candle burns; and the shell constituting a container and providing structural support for the core.

BRIEF DESCRIPTION OF THE DRAWINGS

A better understanding of the objects, features and advantages of the invention can be gained from the following detailed description of the preferred embodiments thereof in conjunction with the appended figures of the drawings, wherein:

FIG. 1 is a top plan view of an embodiment of a fragrance candle according to the invention;

FIG. 2 is an axial sectional view taken along the line 2—2 of FIG. 1 and looking in the direction of the arrows;

FIG. 3 is a top plan view of a modification of the candle of FIG. 1;

FIG. 4 is a top plan view of a further modification of the candle of FIG. 1;

FIG. 5 is an axial sectional view taken along the line 5—5 of FIG. 4 and looking in the direction of the arrows;

FIG. 6 is a top plan view of a currently preferred embodiment of the invention; and FIG. 7 is an axial sectional view taken along the line 7—7 of FIG. 6 and looking in the direction of the arrows.

DETAILED DESCRIPTION OF PREFERRED EMBODIMENTS

FIGS. 1 and 2 show a free-standing fragrance candle 10 according to the invention. The candle 10 comprises an outer shell 12, an inner core 14, and a wick 16.

The shell 12 is formed of a material selected from the group consisting essentially of paraffin, a wax, a mixture thereof, and any of the preceding materials in combination with fragrance oil. The materials are selected so that the shell has a melting point high enough that the shell stands freely and is not tacky at room temperature. For example, the shell may have a melting point within the range of 139° F. to 145° F.

The core 14 is formed of fragrance oil and a carrier therefor and has a melting point below 139° F., for example within the range of 110° F. to 125° F. The fragrance oil in the core 14 constitutes from 5% to 12% of the total weight of the fragrance oil and the carrier.

The carrier is a material selected from the group consisting essentially of petrolatum, a low melting point wax, and a mixture thereof. The core 14 has a melting point substantially lower than the melting point of the shell and low enough to form a molten pool within the shell and to ensure a substantial release of fragrance into the surrounding atmosphere as the candle burns. The shell 12 constitutes a container and provides structural support for the core 14.

Fragrance oil is available commercially from a number of fragrance houses. It typically comprises mineral oil and one or more perfumes.

A fragrance candle according to the invention preferably comprises a number of additional features. Thus while a plurality of wicks each equidistant from the candle axis can be employed, usually there is a single wick 16 which extends along the candle axis.

The candle 10 can have any shape that a conventional unscented candle can have. In FIGS. 1 and 2, the shell 12 and core 14 are cylindrical and disposed concentrically with respect to each other.

In FIG. 3, the shell **12*a* and core 14*a* are square in a cross section taken in a plane normal to the wick 16*a*** and have a common geometric center in such plane.

In FIGS. 4 and 5, the shell **12*b* is irregularly shaped and the core 14*b* is cylindrical. The shell 12*b* and core 14*b* have a common geometric center in a plane normal to the wick 16*b***.

In FIGS. 6 and 7, the shell **12*c* and core 14*c* are cylindrical and disposed concentrically with respect to each other. A thin layer 18 of the shell 12*c* covers the top of the core 14*c* when the candle is manufactured (i.e., before it is lighted), and a somewhat thicker layer 20 extends underneath the core 14*c*. A sustainer 22, typically made of metal, has a central perforation through which the wick 16*c* extends. The sustainer 22 is clamped around the wick 16*c*** at the lower end of the wick and holds the wick upright as the candle burns down, and snuffs out the flame when it reaches the point where the wick enters the sustainer, thus providing a safety feature.

The diameter, cross-sectional area and mass of the core **14*c* are preferably made as large as possible in relation to the diameter, cross-sectional area and mass of the shell 12*c*. For example, the core 14*c* may have a diameter equal to 75% of the diameter of the shell 12*c*, which makes the cross-sectional area of the core 14*c* approximately 28.6% larger than the cross-sectional area of hollow shell 14*c* (the latter being conveniently calculated by subtracting the cross-sectional area of the core from the area of a circle having a diameter equal to the diameter of the shell 12*c***).

For example, in a typical commercial embodiment, the core **14*c* may have a diameter of 3", and the shell 12*c*** may have a diameter of 4", so that the following relations apply, where $r_c$ and $A_c$ are the radius and the cross-sectional area, respectively, of the core and $r_s$ and $A_s$ are the radius and the cross-sectional area, respectively, of the shell:

Cross-sectional area of core **14*c***:

$$A_c = \pi r_c^2 = 9\pi \quad (1)$$

Cross-sectional area of shell **12*c*** (excluding core):

$$A_s = \pi r_s^2 - \pi r_c^2 = \pi(r_s^2 - r_c^2) = \pi(16 - 9) = 7\pi \quad (2)$$

The ratio of the cross-sectional area of the core to the cross-sectional area of the shell is:

$$A_c/A_s = 9\pi/7\pi = 9/7, \quad (3)$$

so that the cross-sectional area of the core exceeds that of the shell by about 28.6%. If the densities of the core and shell are equal, the mass of the core exceeds that of the shell in the ratio 9/7, or by 28.6%.

In accordance with the invention fragrance oil is always incorporated in the core. It is preferably, though not necessarily, also incorporated in the shell. When fragrance oil is incorporated in the shell, it is preferably in the same proportion there as in the core. The advantage of incorporating fragrance oil in the shell in the same proportion as in the core is that this prevents dilution of the fragrance oil in the core by molten wax from the shell as the candle burns. On the other hand, it does not accomplish the objects of the invention to make the entire candle in accordance with the formula for the shell (including fragrance oil), since without a suitable carrier as provided in the core there is insufficient "lift" or release of fragrance into the surrounding atmosphere. And, as previously explained, it does not accomplish the objects of the invention to make the entire candle in accordance with the formula for the core. In other words, for proper functioning the candle must be biconstituent.

The figures of the drawing are merely suggestive of the myriad shapes that can be assumed by both the shell and the core, such shapes being limited only by the imagination of candle designers.

In all cases, the appearance (including color) of the shell and core can be matched, contrasted, or otherwise aesthetically coordinated as suits the predilections of the designer.

The shell 12, **12*a*, 12*b* or 12*c*** can be given essentially its desired form in a dripping or molding operation, or a solid candle can be made of a material suitable for the shell by dripping or molding and then bored out to form a hollow shell. In either case, the shell is filled with a homogeneous mixture of a carrier and fragrance oil, and a wick and preferably a sustainer are inserted. The candle is finished in a conventional manner.

The following examples are representative of a biconstituent candle according to the invention.

EXAMPLE 1

Shell having a melting point of 141° F. and consisting essentially of refined paraffin.

Core having a melting point of 118° F. and consisting essentially of 44% refined petrolatum, 44% refined paraffin, and 12% fragrance oil (pine scent).

EXAMPLE 2

Shell having a melting point of 142° F. and consisting essentially of hard wax.

Core having a melting point of 119° F. and consisting essentially of 74% refined petrolatum, 14% wax and 12% fragrance oil (musk scent).

EXAMPLE 3

Shell having a melting point of 143° F. and consisting essentially of 50% refined paraffin and 50% hard wax.

Core having a melting point of 117° F. and consisting essentially of 55% refined paraffin, 35% refined petrolatum and 10% fragrance oil (honeysuckle scent).

EXAMPLE 4

Shell having a melting point of 144° F. and consisting essentially of refined paraffin.

Core having a melting point of 116° F. and consisting essentially of 90% refined petrolatum and 10% fragrance oil (gardenia scent).

EXAMPLE 5

Shell having a melting point of 145° F. and consisting essentially of refined paraffin.

Core having a melting point of 116° F. and consisting essentially of 90% refined petrolatum and 10% fragrance oil (rose scent).

EXAMPLE 6

Shell having a melting point of 141° F. and consisting essentially of refined paraffin.

Core having a melting point of 118° F. and consisting essentially of 46.25% refined petrolatum, 46.25% refined paraffin and 7.5% fragrance oil (bayberry scent).

EXAMPLE 7

Shell having a melting point of 142° F. and consisting essentially of hard wax.

Core having a melting point of 119° F. and consisting essentially of 76.5% refined petrolatum, 16% wax and 7.5% fragrance oil (musk scent).

EXAMPLE 8

Shell having a melting point of 143° F. and consisting essentially of 50% refined paraffin and 50% hard wax.

Core having a melting point of 117° F. and consisting essentially of 56.5% refined paraffin, 36% refined petrolatum and 7.5% fragrance oil (honeysuckle scent).

EXAMPLE 9

Shell having a melting point of 144° F. and consisting essentially of refined paraffin.

Core having a melting point of 116° F. and consisting essentially of 92.5% refined petrolatum and 7.5% fragrance oil (gardenia scent).

EXAMPLE 10

Shell having a melting point of 145° F. and consisting essentially of refined paraffin.

Core having a melting point of 116° F. and consisting essentially of 92.5% refined petrolatum and 7.5% fragrance oil (rose scent).

EXAMPLE 11

Shell having a melting point of 141° F. and consisting essentially of refined paraffin.

Core having a melting point of 118° F. and consisting essentially of 47.5% refined petrolatum, 47.5% refined paraffin and 5% fragrance oil (pine scent).

EXAMPLE 12

Shell having a melting point of 142° F. and consisting essentially of hard wax.

Core having a melting point of 119° F. and consisting essentially of 78% refined petrolatum, 17% wax and 5% fragrance oil (bayberry scent).

EXAMPLE 13

Shell having a melting point of 143° F. and consisting essentially of 50% refined paraffin and 50% hard wax.

Core having a melting point of 117° F. and consisting essentially of 58% refined paraffin, 37% refined petrolatum and 5% fragrance oil (honeysuckle scent).

EXAMPLE 14

Shell having a melting point of 144° F. and consisting essentially of refined paraffin.

Core having a melting point of 116° F. and consisting essentially of 95% refined petrolatum and 5% fragrance oil (gardenia scent).

EXAMPLE 15

Shell having a melting point of 145° F. and consisting essentially of refined paraffin.

Core having a melting point of 116° F. and consisting essentially of 95% refined petrolatum and 5% fragrance oil (rose scent).

EXAMPLE 16

Shell having a melting point of 139° F. and consisting essentially of 88% refined paraffin and 12% fragrance oil (pine scent).

Core having a melting point of 118° F. and consisting essentially of 44% of refined petrolatum, 44% refined paraffin and 12% fragrance oil (pine scent).

EXAMPLE 17

Shell having a melting point of 140° F. and consisting essentially of 88% hard wax and 12% fragrance oil (musk scent).

Core having a melting point of 119° F. and consisting essentially of 74% refined petrolatum, 14% wax and 12% fragrance oil (musk scent).

EXAMPLE 18

Shell having a melting point of 141° F. and consisting essentially of 50% refined paraffin, 40% hard wax and 10% fragrance oil (bayberry scent).

Core having a melting point of 117° F. and consisting essentially of 55% refined paraffin, 35% refined petrolatum and 10% fragrance oil (bayberry scent).

EXAMPLE 19

Shell having a melting point of 142° F. and consisting essentially of 90% refined paraffin and 10% fragrance oil (gardenia scent).

Core having a melting point of 116° F. and consisting essentially of 90% refined petrolatum and 10% fragrance oil (gardenia scent).

EXAMPLE 20

Shell having a melting point of 143° F. and consisting essentially of 90% refined paraffin and 10% fragrance oil (rose scent).

Core having a melting point of 116° F. and consisting essentially of 90% refined petrolatum and 10% fragrance oil (rose scent).

EXAMPLE 21

Shell having a melting point of 139° F. and consisting essentially of 92.5% refined paraffin and 7.5% fragrance oil (bayberry scent).

Core having a melting point of 118° F. and consisting essentially of 46.25% refined petrolatum, 46.25% refined paraffin and 7.5% fragrance oil (bayberry scent).

EXAMPLE 22

Shell having a melting point of 140° F. and consisting essentially of 92.5% hard wax and 7.5% fragrance oil (musk scent).

Core having a melting point of 119° F. and consisting essentially of 76.5% refined petrolatum, 16% wax and 7.5% fragrance oil (musk scent).

EXAMPLE 23

Shell having a melting point of 141° F. and consisting essentially of 50% refined paraffin, 42.5% hard wax and 7.5% fragrance oil (honeysuckle scent).

Core having a melting point of 117° F. and consisting essentially of 56.5% refined paraffin, 36% refined petrolatum and 7.5% fragrance oil (honeysuckle scent).

EXAMPLE 24

Shell having a melting point of 142° F. and consisting essentially of 92.5% refined paraffin and 7.5% fragrance oil (bayberry scent).

Core having a melting point of 116° F. and consisting essentially of 92.5% refined petrolatum and 7.5% fragrance oil (bayberry scent).

EXAMPLE 25

Shell having a melting point of 143° F. and consisting essentially of 92.5% refined paraffin and 7.5% fragrance oil (rose scent).

Core having a melting point of 116° F. and consisting essentially of 92.5% refined petrolatum and 7.5% fragrance (rose scent).

EXAMPLE 26

Shell having a melting point of 139° F. and consisting essentially of 95% refined paraffin and 5% fragrance oil (pine scent).

Core having a melting point of 118° F. and consisting essentially of 47.5% refined petrolatum, 47.5% refined paraffin and 5% fragrance oil (pine scent).

EXAMPLE 27

Shell having a melting point of 140° F. and consisting essentially of 95% hard wax and 5% fragrance oil (bayberry scent).

Core having a melting point of 119° F. and consisting essentially of 78% refined petrolatum, 17% wax and 5% fragrance oil (bayberry scent).

EXAMPLE 28

Shell having a melting point of 141° F. and consisting essentially of 50% refined paraffin, 45% hard wax and 5% fragrance oil (honeysuckle scent).

Core having a melting point of 117° F. and consisting essentially of 58% refined paraffin, 37% refined petrolatum and 5% fragrance oil (honeysuckle scent).

EXAMPLE 29

Shell having a melting point of 142° F. and consisting essentially of 95% refined paraffin and 5% fragrance oil (gardenia scent).

Core having a melting point of 116° F. and consisting essentially of 95% refined petrolatum and 5% fragrance oil (gardenia scent).

EXAMPLE 30

Shell having a melting point of 143° F. and consisting essentially of 95% refined paraffin and 5% fragrance oil (bayberry scent).

Core having a melting point of 116° F. and consisting essentially of 95% refined petrolatum and 5% fragrance oil (bayberry scent).

Candles prepared in accordance with each of the examples can be shipped, stored and otherwise handled like conventional unscented candles. When burned, they emit a scent as effectively as conventional fragrance candles. While they require no glass or other container, they may be used as refills in containers originally used to protect conventional fragrance candles.

Thus there is provided in accordance with the invention a novel and highly-effective fragrance candle that remedies the problems of conventional fragrance candles. In particular, a fragrance candle in accordance with the invention releases an abundance of fragrance into the surrounding atmosphere as the candle burns, has a pleasant, dry, waxy, non-oily feel, and it not messy to handle and does not stain or soil proximal objects. The candle has enough hardness and structural strength to resist damage and retain its shape even in warm weather, while standing without a container. Moreover, since the shell has a higher melting point than the core, the shell melts more slowly than the core and forms a rim which retains the molten pool formed as the candle burns. This molten pool, which contains fragrance oil at least from the core and in some embodiments from the shell as well, ensures a full release of fragrance into the surrounding atmosphere.

Many modifications of the present invention will readily occur to those skilled in the art upon considering this disclosure. For example, the formulas for the shell and core may be modified according to season, higher melting points being selected for hot weather shipping and storing. Accordingly, the invention is to be construed as including all structure which falls within the scope of the appended claims.

What is claimed is:

1. A free-standing fragrance candle comprising an outer shell, an inner core and a wick;

said shell being formed of a material selected from the group consisting essentially of paraffin, a wax, a mixture thereof, and any of the preceding materials in combination with fragrance oil;

the shell having a melting point high enough that the shell stands freely and is not tacky at room temperature;

said core being formed of fragrance oil and a carrier therefor;

the fragrance oil in said core constituting from 5% to 12% of the total weight of said core;

said carrier being a material selected from the group consisting essentially of petrolatum, a low melting point wax, paraffin, and a mixture thereof;

the core having a melting point substantially lower than the melting point of the shell and low enough to form a molten pool within the shell and to ensure a substantial release of fragrance into the surrounding atmosphere as the candle burns; and said shell constituting a container and providing structural support for said core.

2. A free-standing fragrance candle according to claim 1 wherein said candle is symmetrical about an axis and said wick extends along said axis.

3. A free-standing fragrance candle according to claim 1 wherein said shell and said core are cylindrically shaped and disposed coaxially with respect to each other.

4. A free-standing fragrance candle according to claim 1 wherein said shell and said core are square in cross section.

5. A free-standing fragrance candle according to claim 1 wherein said shell has an irregular shape.

6. A free-standing fragrance candle according to claim 1 wherein said shell has a melting point of 141° F. and consists essentially of refined paraffin; and said core has a melting point of 118° F. and consists essentially of 44% refined petrolatum, 44% refined paraffin and 12% fragrance oil.

7. A free-standing fragrance candle according to claim 1 wherein said shell has a melting point of 142° F. and consists essentially of hard wax; and said core has a melting point of 119° F. and consists essentially of 74% refined petrolatum, 14% wax and 12% fragrance oil.

8. A free-standing fragrance candle according to claim 1 wherein said shell has a melting point of 143° F. and consists essentially of 50% refined paraffin and 50% hard wax; and said core has a melting point of 117° F. and consists essentially of 55% refined paraffin, 35% refined petrolatum, and 10% fragrance oil.

9. A free-standing fragrance candle according to claim 1 wherein said shell has a melting point of 144° F. and consists essentially of refined paraffin; and said core has a melting point of 116° F. and consists essentially of 90% refined paraffin and 10% fragrance oil.

10. A free-standing fragrance candle according to claim 1 wherein said shell has a melting point of 145° F. and consists essentially of refined paraffin; and said core has a melting point of 118° F. and consists essentially of 90% refined petrolatum and 10% fragrance oil.

11. A free-standing fragrance candle according to claim 1 wherein said shell has a melting point of 141° F. and consists essentially of refined paraffin; and said core has a melting point of 118° F. and consists essentially of 46.25% refined petrolatum, 46.25% refined paraffin and 7.5% fragrance oil.

12. A free-standing fragrance candle according to claim 1 wherein said shell has a melting point of 142° F. and consists essentially of hard wax; and said core has a melting point of 119° F. and consists essentially of 76.5% refined petrolatum, 16% wax and 7.5% fragrance oil.

13. A free-standing fragrance candle according to claim 1 wherein said shell has a melting point of 143° F. and consists essentially of 50% refined paraffin and 50% hard wax; and said core has a melting point of 117° F. and consists essentially of 36% refined petrolatum, 56.5% refined paraffin and 7.5% fragrance oil.

14. A free-standing fragrance candle according to claim 1 wherein said shell has a melting point of 144° F. and consists essentially of refined paraffin; and said core has a melting point of 116° F. and consists essentially of 92.5% refined paraffin and 7.5% fragrance oil.

15. A free-standing fragrance candle according to claim 1 wherein said shell has a melting point of 145° F. and consists essentially of refined paraffin; and said core has a melting point of 118° F. and consists essentially of 92.5% refined petrolatum and 7.5% fragrance oil.

16. A free-standing fragrance candle according to claim 1 wherein said shell has a melting point of 141° F. and consists essentially of refined paraffin; and said core has a melting point of 118° F. and consists essentially of 46.25% refined petrolatum, 47.5% refined paraffin and 5% fragrance oil.

17. A free-standing fragrance candle according to claim 1 wherein said shell has a melting point of 142° F. and consists essentially of hard wax; and said core has a melting point of 119° F. and consists essentially of 78% refined petrolatum, 17% wax and 5% fragrance oil.

18. A free-standing fragrance candle according to claim 1 wherein said shell has a melting point of 143° F. and consists essentially of 50% refined paraffin and 50% hard wax; and said core has a melting point of 117° F. and consists essentially of 58% refined petrolatum, 37% refined paraffin and 5% fragrance oil.

19. A free-standing fragrance candle according to claim 1 wherein said shell has a melting point of 144° F. and consists essentially of refined paraffin; and said core has a melting point of 116° F. and consists essentially of 95% refined paraffin and 5% fragrance oil.

20. A free-standing fragrance candle according to claim 1 wherein said shell has a melting point of 145° F. and consists essentially of refined paraffin; and said core has a melting point of 118° F. and consists essentially of 95% refined petrolatum and 5% fragrance oil.

21. A free-standing fragrance candle according to claim 1 wherein said shell incorporates fragrance oil in the same proportion as said core.

22. A free-standing fragrance candle according to claim 1 wherein the melting point of said shell is within the range of 139° F. to 145° F. and the melting point of said core is below 139° F.

* * * * *